US006018288A

United States Patent [19]

Waite et al.

[11] Patent Number: 6,018,288

[45] Date of Patent: Jan. 25, 2000

[54] FLAT RESISTORS FOR AUTOMOTIVE BLOWER MOTOR SPEED CONTROL OR OTHER SERVICE

[75] Inventors: Daryn L. Waite, Mt. Prospect; Raymond S. Anderson, Crystal Lake; Scott D. Smith, West Chicago, all of Ill.

[73] Assignee: Indak Manufacturing Corp., Northbrook, Ill.

[21] Appl. No.: 09/078,968

[22] Filed: May 14, 1998

Related U.S. Application Data

[60] Provisional application No. 60/047,533, May 23, 1997.

[51] Int. Cl.[7] ..... H01C 1/02

[52] U.S. Cl. ..... 338/254; 338/243; 338/246

[58] Field of Search ..... 338/215, 172, 338/185, 200, 254, 243, 246, 249

[56] References Cited

U.S. PATENT DOCUMENTS

| | | | |
|---|---|---|---|
| 2,939,807 | 6/1960 | Needham | 117/212 |
| 3,441,895 | 4/1969 | Schwartz | 338/256 |
| 3,808,573 | 4/1974 | Cappell | 338/249 |
| 3,809,859 | 5/1974 | Wells | 219/345 |
| 5,270,521 | 12/1993 | Shikama et al. | 219/530 |
| 5,804,791 | 9/1998 | Gelus | 219/245 |

*Primary Examiner*—Lincoln Donovan
*Assistant Examiner*—Richard K. Lee
*Attorney, Agent, or Firm*—Palmatier & Zummer; Francois N. Palmatier; Anthony S. Zummer

[57] ABSTRACT

The flat resistor comprises a stack of flat components including a first metal plate having assembly tabs bent, a first outer electrical insulator having alignment slots for receiving the tabs, a first sheet metal resistance element having slots for receiving the tabs with a clearance fit, a first inner electrical insulator having alignment slots for receiving the tabs, a metal midplate having oversize slots for receiving the tabs with a clearance fit, a second thin inner insulator having alignment slots for receiving the tabs, a second sheet metal resistance element having clearance slots for receiving the tabs, a second thin outer insulator having alignment slots for receiving the tabs, and a second metal outer plate having alignment slots for receiving the tabs, which are bent into engagement with the second plate for compressing the stack. The resistance elements have alignment tabs extending through alignment slots in the corresponding outer insulators and securely bent behind the insulators. The outer plates have clearance voids formed by outward embossments opposite the bent tabs. A thermal fuse is pressed by a wire spring against a V-shaped seat comprising lugs bent from the midplate at oppositely slanting angles. The wire spring is connected between the fuse and the lugs.

32 Claims, 7 Drawing Sheets

FIG. 11
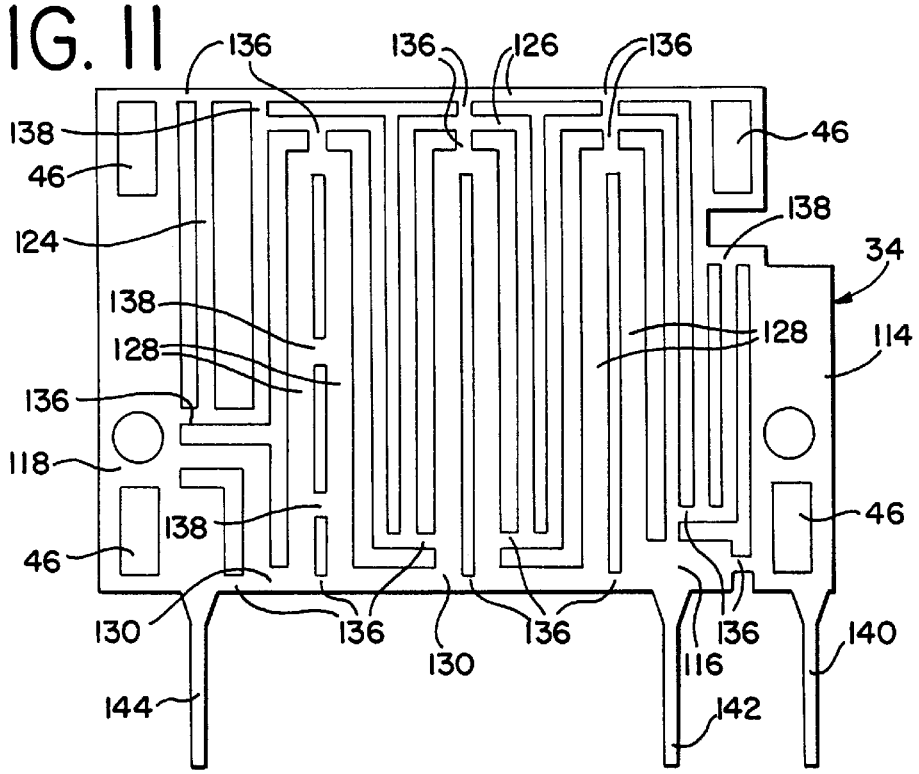
FIG. 12
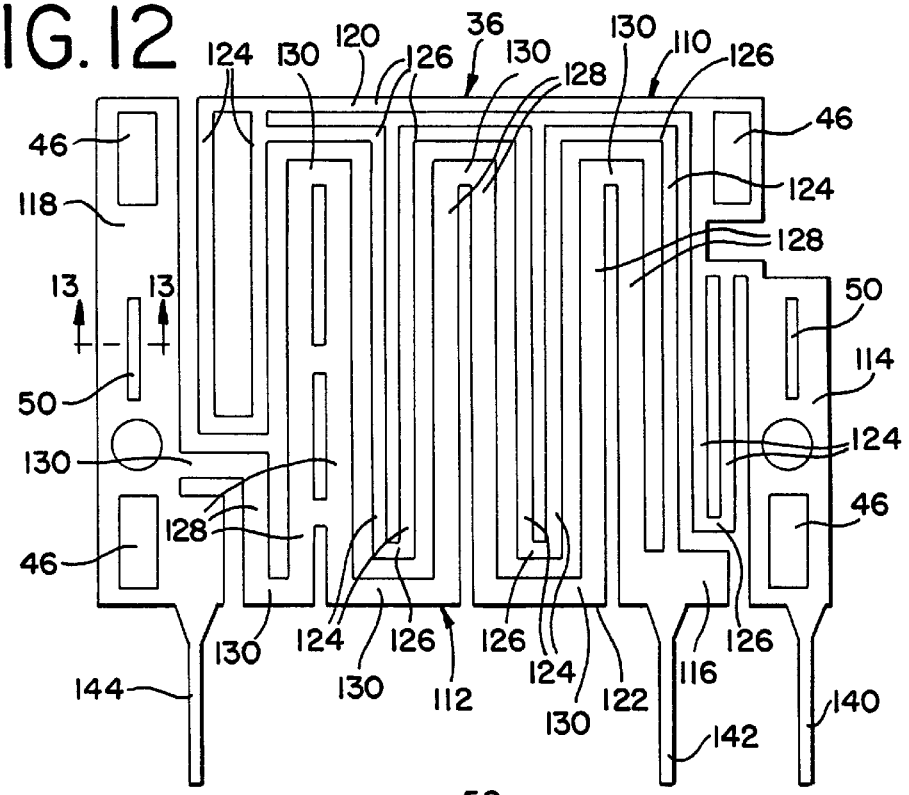
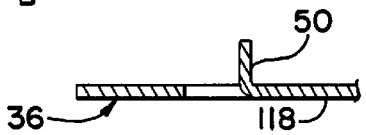
FIG. 13

FLAT RESISTORS FOR AUTOMOTIVE BLOWER MOTOR SPEED CONTROL OR OTHER SERVICE

This Application claims the benefit og U.S. Provisional Application No. 60/047,533 filed May 23, 1997.

FIELD OF THE INVENTION

This invention relates to flat resistor constructions and pertains particularly to improved flat resistors for automotive blower motor speed control, especially in automotive heating, air conditioning and ventilating systems. However, other applications for the invention will be evident to those skilled in the art.

BACKGROUND OF THE INVENTION

This most common method of achieving automotive heating and air conditioning blower motor speed control is by the use of an open coil resistor assembly comprising one or more individual coil elements, usually connected electrically in series. Operation of a blower switch located on the vehicle instrument panel connects the blower motor to none, 1, 2 or more of the resistance elements to progressively decrease the speed of the motor from its highest speed to lower speeds. An advantage of this design is that the individual resistance values of the elements may readily be varied to optimize performance of a particular vehicle system design. The resistor assembly is usually located downstream from the motor and blower in the climate control air ducts built into the vehicle, whereby the moving air stream cools the elements during normal operation. During a fault condition, such as failure of the blower motor shaft to rotate due to a locked rotor, the open coil resistors may be heated to unacceptably high temperatures. A thermal fuse located above the resistance elements is often employed to limit the temperature rise during a fault condition by opening the resistor and motor circuit in response to an increase in convected and radiated heat from one or more of the resistance elements. In other applications, the resistor assembly does not include a thermal fuse, but is located in an area where high temperatures will not adversely affect the surroundings.

Some other resistor products use flat plates relying on resistive ink elements screen printed on either a ceramic or an enameled metal base and utilizing melting solder connections between the resistive elements to limit temperature rise during fault conditions.

An improved resistor construction is disclosed in the co-pending application of Charles E. Black, III and Daryn L. Waite, entitled BLOWER SPEED CONTROL RESISTORS FOR AUTOMOTIVE OR OTHER SERVICE filed as a PROVISIONAL APPLICATION FOR PATENT in the U.S. Patent and Trademark Office on May 9, 1997, Serial No. 60/046,901, and as a standard patent application on Oct. 9, 1997, Ser. No. 08/947,574. In such improved construction, the resistor comprises a sandwich of essentially flat stampings, preferably assembled in the following order: a flat outer metal plate; an outer insulator; a flat, stamped resistance element; an inner insulator; a midplate; another inner insulator; another flat, stamped resistance element; another outer insulator; and a second outer metal plate. Because the components are flat, they can be held in intimate contact with one another to facilitate heat transfer from the resistance elements to the midplate and also to the outer plates which are located in the cooling air stream. Common tooling may be used to stamp the basic resistance elements from thin resistive stock. Structural tie bars or webs which are subsequently removed at the assembly point are left between resistive paths for structural integrity during handling. The resistance elements may be designed with parallel paths to spread the generation of heat over a larger area. Alternatively, series paths may be required to obtain high enough element resistance in the package size allowed. Regardless, additional severable bypass tie bars or bridges are also left which create parallel paths in the individual resistance elements. Making minor changes in the assembly tooling permits trimming out some of these bypass tie bars at the same operation where the structural tie bars are removed, permitting flexibility in the choice of resistance of the individual elements without significant cost effect.

The flat resistor construction of such co-pending application also includes high integrity connections of the resistance elements to each other and to the connection terminals of the electrical circuit. Each connection is accomplished by folding the resistive material into a three-layer thickness "tube" or wire-like prong without cutting the material. The tube or prong may then be assembled by the same high reliability techniques previously employed for the round wire resistance elements. In accordance with such techniques, shear formed loops are provided in the terminals and are pressed against the ends or prongs of the resistance elements, forming a mechanically and electrically sound and secure junction. Connection of one resistance element to another may be accomplished by means of a tie bar if size restrictions allow both elements to be on the same side of the midplate. To minimize the overall package size, however, the resistance elements of a two or more element design should be positioned on opposite sides of the midplate. Shear formed loops in the midplate itself may then act as connecting means when pressed against the "tubes" or wire-like prongs formed on the flat resistance elements.

In the resistor construction of such co-pending application, a thermal fuse is preferably used between the "last" resistance element and the output terminal. The thermal fuse is engaged with the midplate for good heat transfer. The circuit-opening temperature of the thermal fuse is selected to lie between the maximum thermal fuse temperature reached during normal operation and the minimum thermal fuse temperature reached during a fault condition in which the air stream ceases due to locked rotor failure of the blower motor opening of the thermal fuse limits the temperature rise of the outer plates to a value that is safe for the surroundings.

In the resistor construction of such co-pending patent application, the flat components of the resistor unit are stacked to form a flat pack and are fastened together to form a secure assembly by rivets or other similar fasteners, inserted through holes in the flat components. The holes in the flat resistance elements and the midplate are oversize clearance holes, substantially larger than the shank diameter of the rivets, so that the rivets will not engage the resistance elements and the midplate. The holes in the outer plates and the insulators are only slightly larger than the shank diameter of the rivets for establishing alignment between the outer plates and the insulators. During the assembly of the flat components, the resistance elements and the midplate are aligned with the outer plates and the insulators by suitable means or manually. The rivets are then upset so that they securely clamp the flat components together, whereby all of the flat components are securely and permanently maintained in alignment.

This riveted construction suffers from the disadvantage that unskillful assembly can possibly cause misalignment between the rivets and the resistance elements so that the resistance elements can possibly come into contact with the rivets, in which case the assembled resistor is faulty and must be rejected.

SUMMARY OF THE INVENTION

One object of the present invention is to provide a new and improved flat package resistor unit having new and improved alignment and clamping means which are superior to the riveted construction employed heretofore.

Another object is to provide a new and improved resistor construction having an improved alignment and clamping system which inherently establishes and maintains the desired alignment of the flat components so as to prevent the production of defective resistor units.

A further object is to provide a new and improved alignment and clamping system which eliminates the use of rivets or other separate fasteners and employs alignment and clamping elements formed on the flat components.

Another object is to provide a flat package resistor construction having new and improved spring means for pressing the thermal fuse into firm engagement with the midplate so that good thermal conductivity is established and maintained between the thermal fuse and the midplate.

In accordance with the present invention, a plurality of clamping and alignment tabs are formed on one of the outer plates and are bent substantially at right angles thereto for reception in a first set of alignment slots in the outer insulators, the resistance elements, the inner insulators, the midplate and the other outer plate. The slots in the resistance elements and the midplate are oversize clearance slots, while the slots in the insulators and the other outer plate are only slightly larger than the tabs on the first outer plate.

Each of the resistor elements is formed with a pair of additional alignment tabs which are sheared therefrom and are bent substantially perpendicular thereto, for reception in additional alignment slots formed in two of the insulators, preferably the outer insulators. The alignment slots in the insulators are only slightly larger than the alignment tabs on the resistance elements so that alignment between the resistance elements and the insulators is inherently maintained when the resistance elements are assembled with the insulators.

Thus, the alignment of both of the outer plates and all of the insulators is established and maintained by the reception of the tabs on the first outer plate in the closely fitting slots formed in the insulators and the other outer plate. The desired alignment of the resistance elements with the outer plates and the insulators is established and maintained by the reception of the tabs on the resistance elements in the closely fitting slots formed in the outer insulators. The midplate is easily aligned with the outer plates during the assembly procedure, by means of dowel pins of the assembly fixture, not shown.

The entire package of the flat components is clamped and secured together by bending the tabs on the first outer plate toward each other and against the second outer plate. Great clamping forces are exerted on the bent tabs to ensure that all of the components are forcefully clamped together, whereby good thermal conductivity is established and maintained between the resistance elements, the inner and outer insulators, the outer plates and the midplate. The alignment tabs on the resistance elements ensure that they will not come into contact with the tabs on the first outer plate.

The flat resistor of the present invention also includes means for preventing any electrical contact between the alignment tabs on the resistance elements and the outer plates. For this purpose, the outer plates are formed with recessed portions located opposite the alignment tabs on the resistance elements. The alignment tabs extend through the alignment slots in the outer insulators and into the recesses, which prevent the alignment tabs from coming into contact with the outer plates. By virtue of this construction, the alignment tabs on the resistance elements can be slightly longer than the thickness of the outer insulators, so that the alignment tabs can extend completely through the alignment slots in the outer insulators and slightly beyond the outer insulators, into the recessed portions of the outer plates.

The body of the thermal fuse is pressed continuously into good thermally conductive engagement with the midplate by providing spring means for exerting force on the thermal fuse. Preferably, the spring means take the form of a wire spring which is mounted on the midplate ends and is flexed and retained against the thermal fuse. Thus, good thermal conductivity is established and maintained between the midplate and the thermal fuse. The midplate is formed with a clip-shaped seat for receiving the body of the thermal fuse and for receiving the wire spring. A guard is provided for the spring clip.

BRIEF DESCRIPTION OF THE DRAWINGS

Further objects, advantages and features of the present invention will appear from the following description, taken with the accompanying drawings, in which:

FIG. 11 is a plan view of the second flat resistance element, as partially stamped and in an early stage of production with all of the structural tie bars or webs still in place.

FIG. 12 is a view similar to FIG. 11, but with the structural tie bars or webs punched or otherwise removed from the resistance element, and with the alignment tabs sheared and formed from the resistance element, substantially at right angles thereto.

FIG. 13 is a fragmentary enlarged sectional view, taken generally along the line 13—13 in FIG. 12.

DETAILED DESCRIPTION OF AN ILLUSTRATIVE EMBODIMENT

Figure 1:
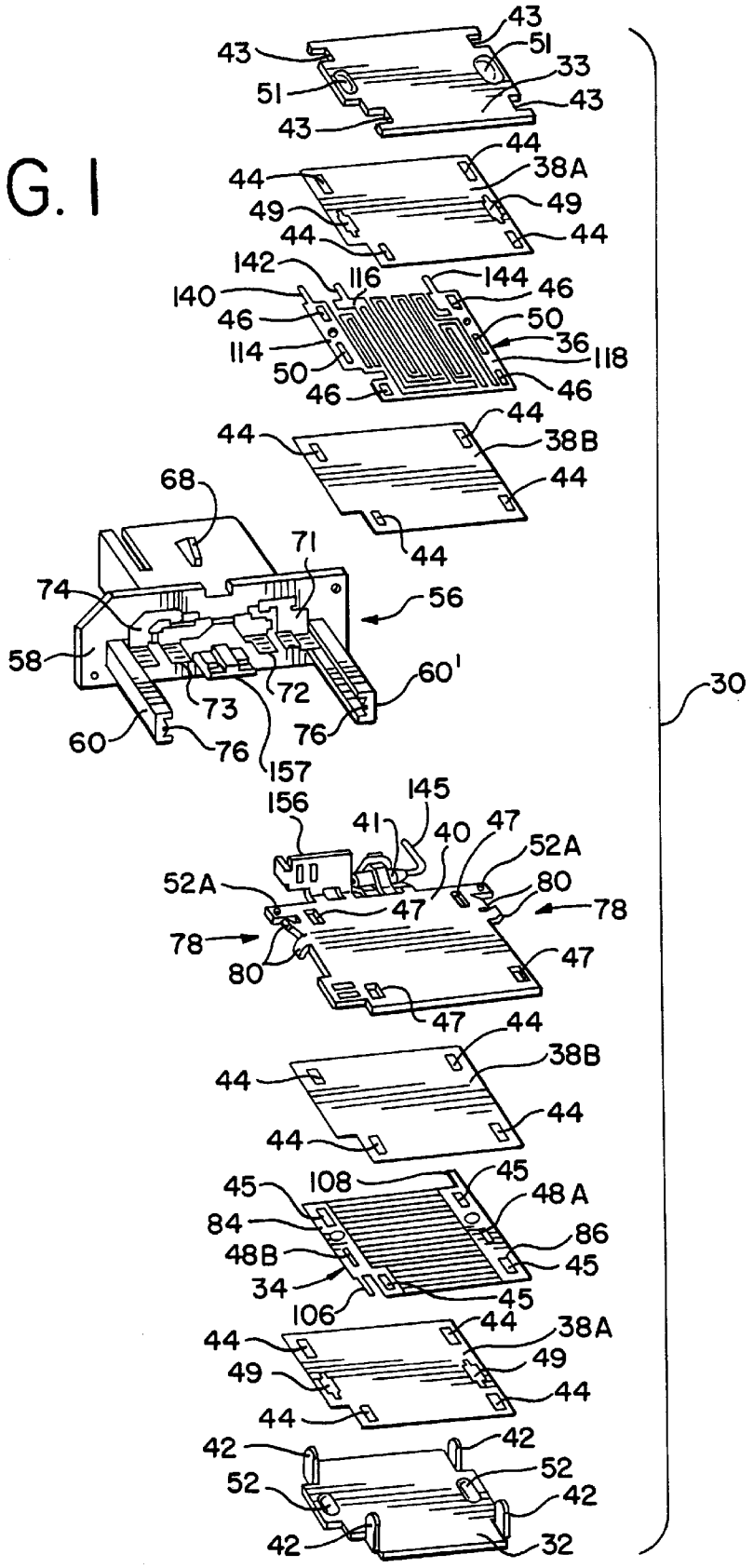
FIG. 1 is an exploded view of a disassembled flat profile resistor package or unit to be described as an illustrative embodiment of the present invention.
Figure 2:
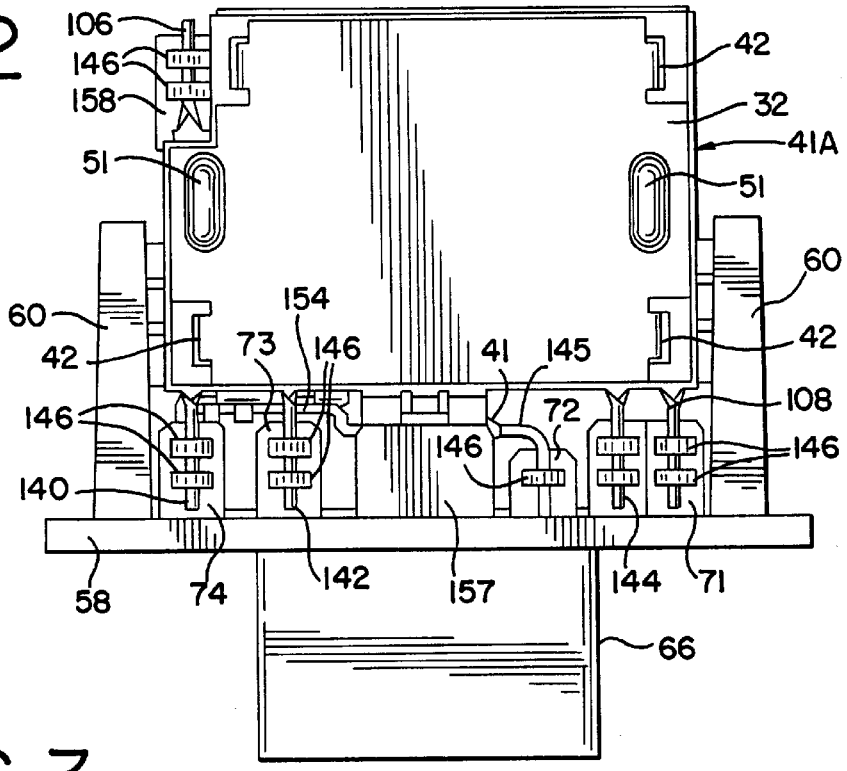
FIG. 2 is a plan view of the resistor unit of FIG. 1.
Figure 3:
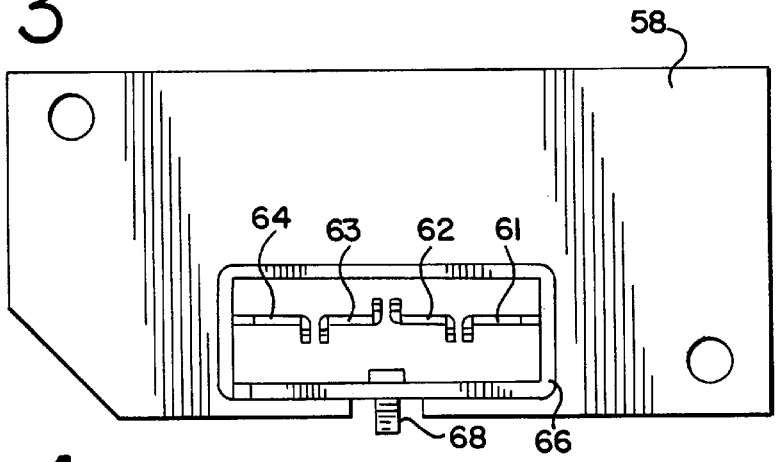
FIG. 3 is a front elevational view of the resistor unit.
Figure 4:
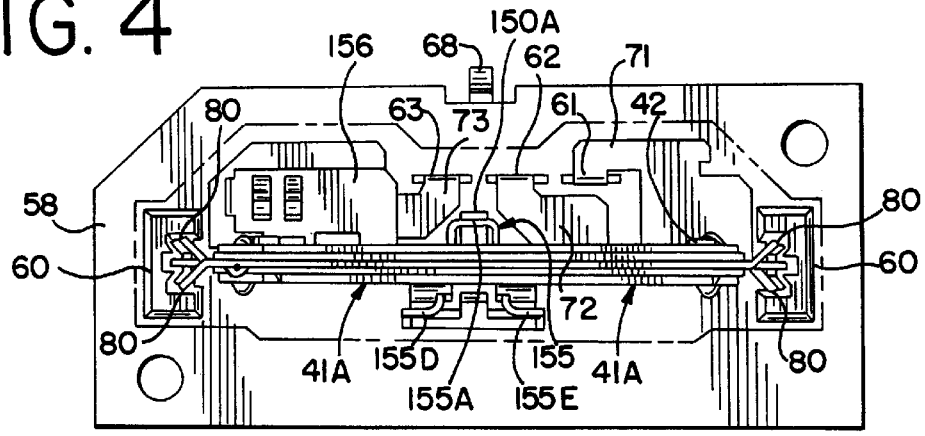
FIG. 4 is a rear elevational view of the resistor unit.

As just indicated, FIG. 1 is an exploded view of a resistor unit 30 to be described as an illustrative embodiment of the present invention. The fully assembled resistor 30 is shown in FIGS. 2, 3 and 4. The resistor unit 30 is sometimes referred to herein as the resistor 30.

As shown in FIG. 1, the resistor unit 30 comprises a multiplicity of generally flat, plate-like components which are adapted to be stacked and secured together. The stack of components, as shown in FIG. 1, is sandwiched between first and second outer plates 32 and 33 which are located at the lowermost and uppermost ends of the stack, as shown in FIG. 1. The outer plates 32 and 33 are preferably made of sheet metal, such as aluminum or an aluminum alloy, such as Type 5052, for example, because of its good heat conductivity, and are sufficiently thick to be substantially rigid.

The stack of FIG. 1 also comprises first and second thin, flat resistance elements 34 and 36, made at least in part of electrically conductive material, preferably thin sheet metal, such as some type of aluminum chromium iron alloy or other alloy which has a desirable electrical resistivity and is resistant to corrosion. Several commercial resistive materials have been employed successfully, including ALCHROME D, KANTHAL D and HOSKINS 815. Other commercially available, electrically resistive metal materials can be used. Preferably the resistance elements 34 and 36 are fairly thin, such as approximately 0.25 mm, for example.

The stack of components of the resistor unit 30 comprise outer and inner thin, flat insulators 38A and 38B to provide electrical insulation on both the outer sides and the inner sides of the first and second resistance elements 34 and 36. The insulators 38A and 38B are in the form of thin, flat sheets, preferably made of a resinous plastic material which is capable of withstanding high temperatures, ranging up to approximately 220 degrees C, that may be produced by the resistance elements 34 and 36 under certain conditions. For example, the insulators 38A and 38B may be made of DUPONT KAPTON HN sheet material or DUPONT NOMEX sheet material, or other equivalent materials. There are two of the outer insulators 38A, the first of which is stacked between the first outer plate 32 and the outer side of the first resistance element 34. The second outer insulator 38A is sandwiched between the uppermost or second outer plate 33 and the outer side of the second resistance element 36. Likewise, there are two of the inner insulators 38B, the first of which is sandwiched between a midplate 40 and the other side of the first resistance element 34. The second inner insulator 38B is sandwiched between the midplate 40 and the inner side of the second resistance element 36, as shown in FIG. 1.

Preferably, the outer insulators 38A are thicker than the inner insulators 38B so that the thermal conductivity between each of the flat resistance elements 34 and 36 and the midplate 40 is greater than the thermal conductivity between each of the resistance elements 34 and 36 and the corresponding outer plates 32 and 33. As a result, the midplate 40 is heated more rapidly than the outer plates 32 and 33 during a fault condition due to interruption of the air stream caused by a locked rotor in the blower motor. A thermal fuse or limiter 41 is also heated more rapidly because it is in thermal contact with the midplate 40. Consequently, the thermal fuse 41 is heated to its circuit-opening temperature before the outer plates 32 and 33 are heated to an unacceptably high temperature. In a presently preferred embodiment, each of the outer insulators 38A has a thickness of about 0.50 mm, while each of the inner insulators 38B has a thickness of about 0.13 mm. It will be understood that the thickness can be varied.

The midplate 40 is preferably in the form of sheet metal, which may be made of steel, for example, or any other suitable metal or alloy having good electrical and heat conductivity. Ordinary low-cost, SAE 1010 carbon steel has been successfully employed for the midplate 40. The thickness of the midplate 40 can be less than that of the outer plates 32 and 33. For example, a midplate 40 having a thickness of approximately 0.81 mm has been successfully employed in a resistor unit 30 having outer plates 32 and 33 made of aluminum alloy sheet metal with a thickness of approximately 1.0 mm. Outer plates 32 and 33 made of steel can also be employed.

In FIG. 1, the various flat components of the resistor unit 30 are stacked vertically in the following order, starting with the lower end of the illustrated stack: the first outer plate 32, one of the outer insulators 38A, the first resistance element 34, one of the inner insulators 38B, the midplate 40, another inner insulator 38B, the second resistance element 36, another outer insulator 38A and the second outer plate 33.

The stacked components of the resistor unit 30 are fastened and clamped together to form a secure subassembly 41A, as shown in FIGS. 2, 4, 5 and 6. In accordance with the present invention, the stacked components are aligned and clamped together by a plurality of fasteners in the form of alignment and clamping tabs 42 which are bent upwardly from the first outer plate 32 at approximately 90 degrees so that the tabs 42 are substantially perpendicular to the plane of the outer plate 32, as shown in FIG. 1. The illustrated outer plate 32 is formed with four such tabs 42, located near the corners of the plate 32 which is generally rectangular in shape. Four alignment slots 43 for receiving the tabs 42 are formed in the second outer plate 33. Similarly, four alignment slots 44 are formed in each of the outer and inner insulators 38A and 38B. The size and location of the alignment slots 43 and 44 are such that the alignment tabs 42 are closely received in the slots 43 and 44. The size of the alignment slots 43 and 44 is only slightly larger than the size of the alignment tabs 42.

Figure 8:
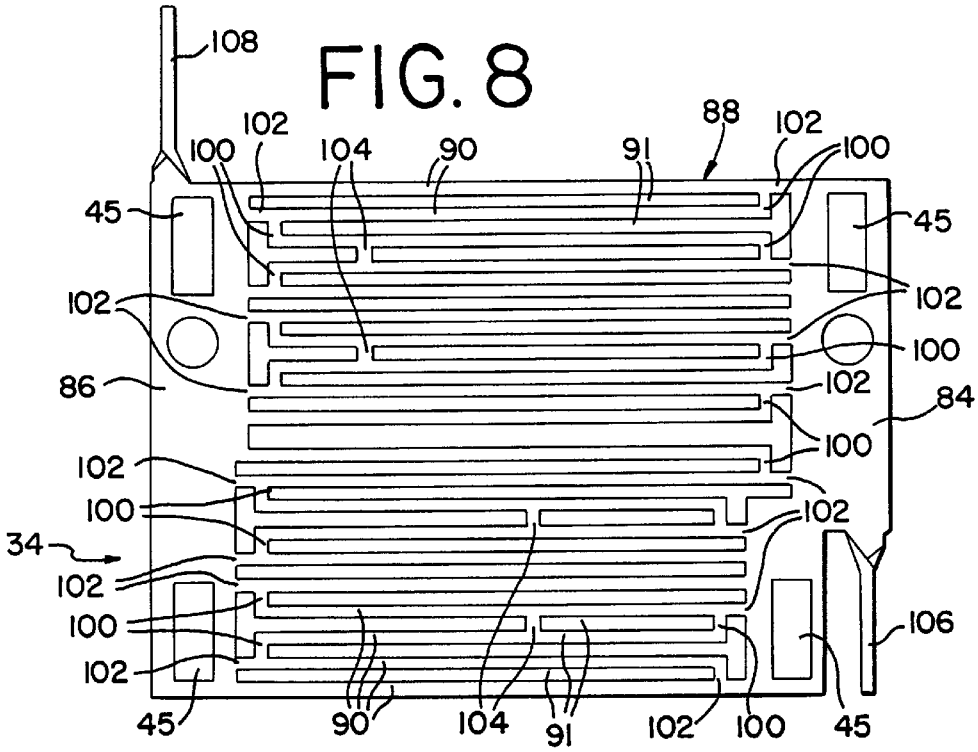
FIG. 8 is a plan view of a first resistance element as partially stamped and in a preliminary stage of manufacture, and showing all of the structural tie bars or webs still in place.
Figure 18:
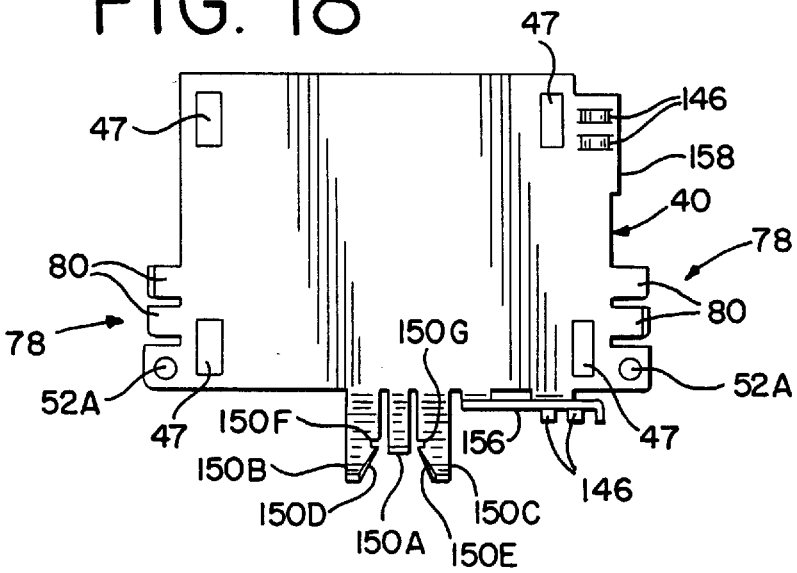
FIG. 18 is a plan view of the midplate.

As shown in FIGS. 1 and 8, the first resistance element 34 is formed with four clearance slots 45 for receiving the tabs 42 on the first outer plate 32. The slots 45 are oversize clearance slots, larger than the size dimensions of the alignment tabs 42, so that the tabs 42 will not engage the first resistance element 34. As shown in FIGS. 1, 11 and 12, the second resistance element 36 is also formed with four oversize clearance slots 46 for receiving the tabs 42, without engaging them. As shown in FIGS. 1 and 18, the midplate 40 is formed with four oversize clearance slots 47 for receiving the four tabs 42 without engaging them.

Figure 9:
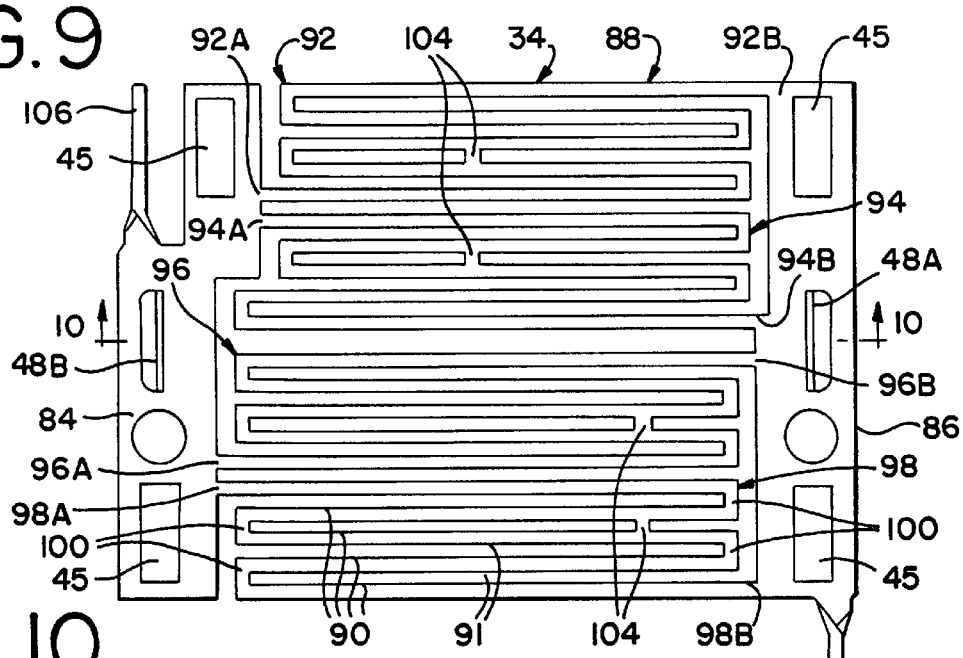
FIG. 9 is a plan view of the first resistance element with the structural tie bars or webs removed and with the alignment tabs sheared and bent, substantially at right angles to the plane of the resistance element.
Figure 10:
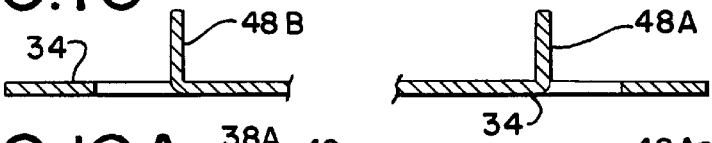
FIG. 10 is a fragmentary enlarged sectional view, taken along the line 10—10 in FIG. 9 and showing the bent alignment tabs.

As shown in FIGS. 9 and 10, the first resistance element 34 is formed with a pair of alignment projections or tabs 48 which are sheared and bent from the flat resistance element 34 so as to be substantially perpendicular thereto.

Figure 15:
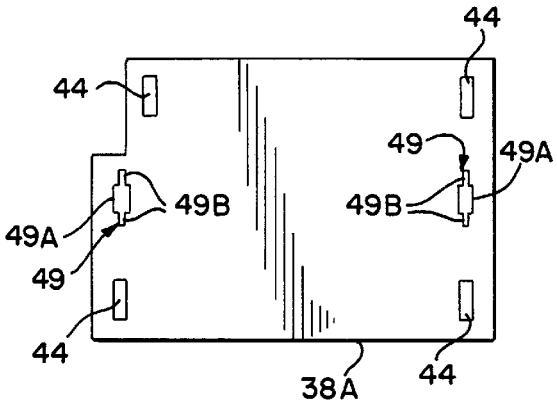
FIG. 15 is a plan view of one of the two outer insulators.
Figure 16:
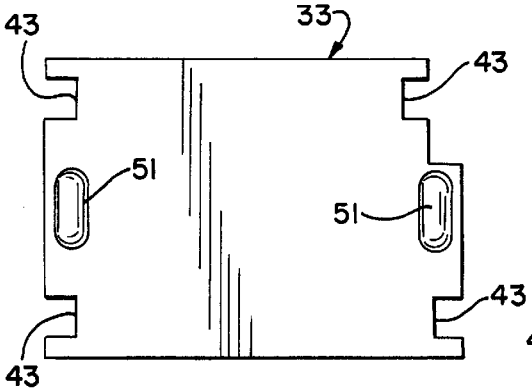
FIG. 16 is a plan view of the outer plate which is uppermost in FIG. 1.

In the assembled resistor unit 30, the alignment tabs 48 extend into and are located by a pair of closely fitting alignment slots 49 formed in the adjacent outer insulator 38A. As shown in FIG. 15, each of the alignment slots 49 has a relatively wide central portion 49A and a pair of narrower end portions 49B. The alignment tabs 48 on the first resistance element 34 are received in the narrower end portions 49B with an easy sliding fit, whereby the resistance element 34 is maintained in the desired alignment with the outer insulator 38A, so that the first resistance element 34 is prevented from coming into contact with the tabs 42 on the first outer plate 32.

Figure 10A:
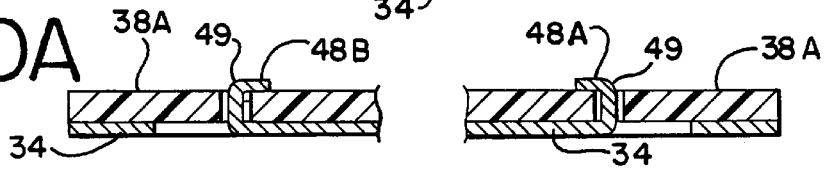
FIG. 10A is a similar fragmentary enlarged section, but with the adjacent insulator added and with the tabs inserted through the slots therein and folded behind the insulator.
Figure 14:
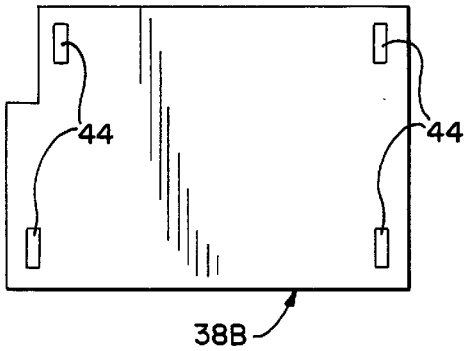
FIG. 14 is a plan view of one of the two inner insulators.

FIG. 10A is a fragmentary sectional view taken through the first resistance element 34 and the adjacent outer insulator 38A in their assembled relationship. It will be seen that the alignment tabs 48 are inserted through the alignment slots 49 in the outer insulator 38A. The alignment tabs 48 are then folded over, on the outer side of the insulator 38A so that the first resistance element 34 is securely retained on the outer insulator 38A. The combination of the first resistance element 34, the outer insulator 38A, the inner insulator 38B, and the midplate 40 constitute a subassembly which is easy to invert and assemble or stack on the first outer plate 32, so that the alignment tabs 42 on the plate 32 extend through the alignment slots 44 in the adjacent outer insulator 38A, through the oversize clearance slots in the resistance element 34, through the alignment slots 44 in the adjacent inner insulator 38B, and through the oversize clearance slots in the midplate 40.

The wide central portion 49A of each of the alignment slots 49 is provided to increase the visibility of the slots 49, so that the alignment tabs 48 can easily be inserted through the alignment slots 49 in the assembly of the first resistance element 34 and the adjacent outer insulator 38A.

As shown in FIGS. 12 and 13, the second resistance element 36 is formed with a pair of alignment projections or tabs 50 which are sheared and bent from the flat resistance element 36 so as to be substantially perpendicular thereto. The second outer insulator 38A which is adjacent the second resistance element 36 is the same in construction as the first outer insulator 38A, already described in detail, and thus is formed with its own pair of alignment slots 49, as shown in FIG. 15, each of which has the relatively wide central portion 49A and a pair of narrow end portions 49B for receiving the tabs 50 with an easy sliding fit, whereby the second resistance element 36 is maintained in the desired alignment with the adjacent outer insulator 38A, so that the second resistance element 36 is prevented from coming into contact with the tabs 42 on the first outer plate 32.

The two alignment tabs 50 on the second resistance element 36 are preferably slightly longer than the thickness of the adjacent outer insulator 38A, so that the tabs 50 will extend entirely through the alignment slots 49 in the insulator 38A, but the tabs 50 are shorter than the alignment tabs 48 on the first resistance element 34. The alignment tabs 50 on the second resistance element 36 extend entirely through the alignment slots 49 in the adjacent outer insulator 38A, and are not folded over behind the insulators 38A. The resistor unit 30 is provided with means for preventing the end of the alignment tabs 48 and 50 from contacting respective outer plates 32 and 33.

Figure 17:
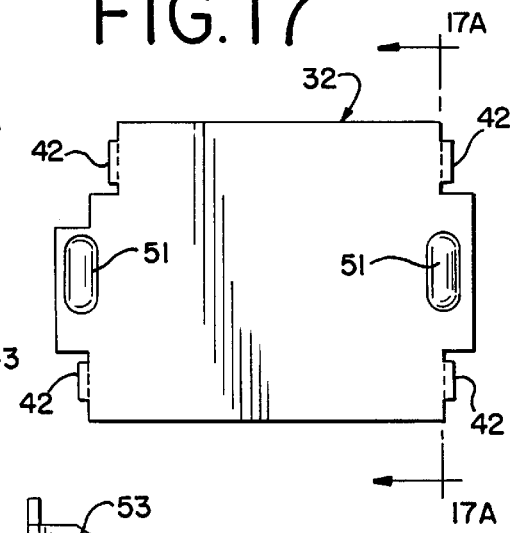
FIG. 17 is a plan view of the outer plate which is lowermost in FIG. 1.
Figure 17A:
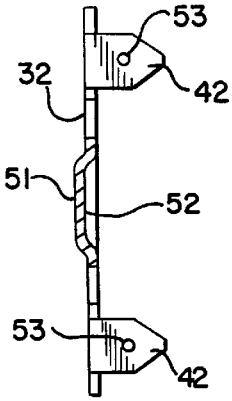
FIG. 17A is a fragmentary section view, taken generally along the line 17A—17A in FIG. 17.

As shown to best advantage in FIG. 17A, the first and second outer plates 32 and 33 are formed with means in the form of embossments 51, producing recesses 52 on the inner sides of the outer plates 32 and 33 for receiving the ends of the alignment tabs 48 and 50 on the respective first and second resistance elements 34 and 36. The recesses 52 are sufficiently large and deep to afford clearance for the ends of the alignment tabs 48 and 50, so as to prevent the tabs 48 and 50 from coming into contact with the outer plates 32 and 33.

Each of the outer plates 32 and 33 is formed with a pair of the embossments 51 and a corresponding pair of the recesses 52, which are located so that they are opposite the ends of the alignment tabs 48 and 50. The embossments 51 project outwardly from the outer plates 32 and 33, while the recesses 32 face inwardly on the inner sides of the plates 32 and 33. The recesses 52 effectively provided clearance openings in the outer plates 32 and 33 for receiving the ends of the corresponding alignment tabs 48 and 50.

When the subassembly 41A is assembled, the alignment tabs 42 on the first outer plate 32 establish and maintain the desired alignment of the outer and inner insulators 38A and 38B and the second outer plate 33. The desired alignment of the first resistance element 34 is established and maintained by the alignment tabs 48 thereon, which are closely received in the alignment slots 49 in the adjacent outer insulator 38A. The desired alignment of the second resistance element 36 is established and maintained by the alignment tabs 50 thereon, which are closely received in the alignment slots 49 in the adjacent outer insulator 38A. The desired alignment of the midplate 40 is established by aligning holes 52A, formed in the midplate 40, with dowel pins, present in the assembly fixture, not shown. The assembly fixture also establishes alignment of the dowel pins to the perimeter of the outer plate 32.

The subassembly 41A is clamped together by bending or folding the protruding end portions of the alignment tabs 42 toward each other and into forceful engagement with the second outer plate 33, as shown in FIG. 4. To facilitate the folding of the tabs 42, each of them is formed with a small hole 53, as shown in FIG. 17A, located where the tab 42 is to be folded.

Figure 5:
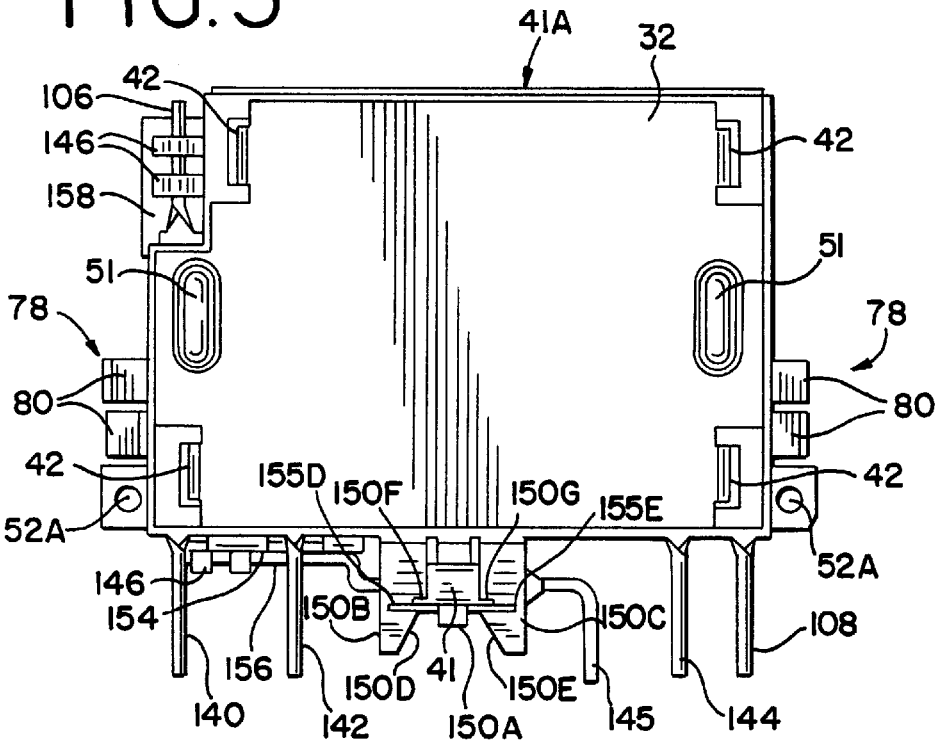
FIG. 5 is a plan view of the partially assembled resistor unit, before it is assembled with the terminal head.
Figure 6:
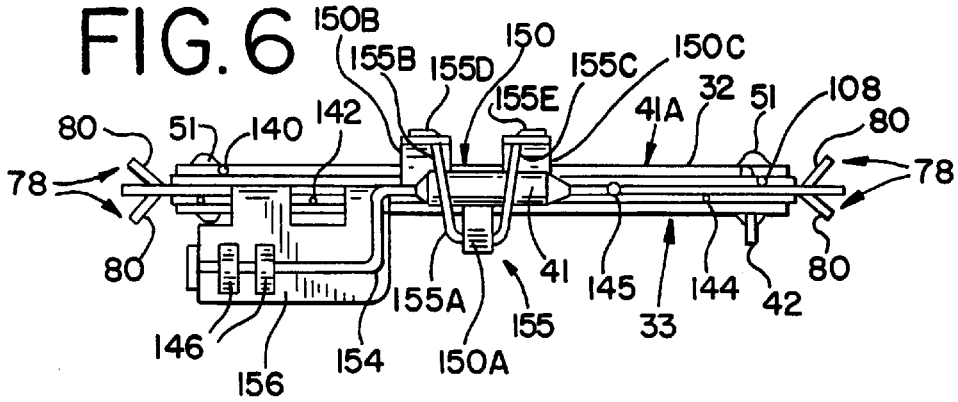
FIG. 6 is a front elevational view of the partially assembled resistor unit of FIG. 5.

The components of the resistor unit 30, when stacked and clamped together as described thus far, form the subassembly 41A which is illustrated separately in FIGS. 5 and 6. The subassembly 51A is adapted to be assembled with a terminal head 56, illustrated separately in FIG. 1. The assembled combination of the subassembly 41A and the terminal head 56 constitutes the complete resistor unit 30, which is shown in a fully assembled state in FIGS. 2, 3 and 4.

As shown in FIGS. 1 and 2, the terminal head 56 comprises a front plate 58 and a pair of side arms or channels 60 projecting rearwardly from the front plate 58 for supporting the subassembly 41A. As shown, the side arms 60 are substantially perpendicular to the front plate 58. Preferably, the front plate 58 and the side arms 60 are molded in one piece from a resinous plastic material which is capable of withstanding the heat generated by the resistor unit 30 under certain conditions. For example, the terminal head 56 is preferably molded in one piece of glass filled nylon comprising a high-temperature nylon resin having glass reinforcing fibers embedded therein.

To establish electrical connections to the resistor elements 34 and 36, the terminal head 56 comprises four flat electrically-conductive terminal prongs 61, 62, 63 and 64, extending through the front plate 58 and projecting forwardly therefrom for receiving a connector plug (not shown) whereby the resistor unit 30 is connected into the electrical system of the vehicle. The prongs 61, 62, 63 and 64 are made of an electrically conductive metal, preferably copper, having a corrosion resistant plating thereon. However, the prongs may also be made of a less expensive metal such as plated steel, for example.

As shown in FIGS. 2 and 3, the four prongs 61–64 are surrounded and protected by a hollow tubular housing 66 for receiving the body of a connector plug (not shown). The housing 66 projects forwardly from the front plate 58 and is preferably molded in one piece with the front plate 58 and the side arms 60. As viewed in FIG. 3, the housing 66 is generally rectangular in shape. A rib or key 68 projects from the housing 66 to interfit with a component of the connector plug.

The four terminal prongs 61, 62, 63 and 64 are formed in one piece with respective electrically conductive terminals 71, 72, 73 and 74, mounted on and projecting rearwardly from the front plate 58 of the terminal head 56. The first and second resistance elements 34 and 36 are electrically connected to the terminals 71, 72, 73 and 74, in a manner which will be described subsequently herein.

As shown in FIG. 4, the side arms 60 of the terminal head 56 are adapted to support the subassembly 41A of the resistor unit 30. As shown most clearly in FIG. 1, the side arms 60 of the terminal head 56 are formed with oppositely facing channels 76 for receiving and supporting edge portions of the subassembly 41A. As illustrated in FIGS. 5 and 6, such edge portions comprise flange means 78 on the opposite side edges of the midplate 40. More specifically, such flange means 78 may comprise a pair of flanges or tabs 80 bent in opposite directions from the horizontal at approximately 45 degrees thereto on both edge portions of the midplate 40, as shown most clearly in FIGS. 5 and 6. Flanges having other shapes can be employed. The flanges 80 are slidably receivable in the channels 76 formed in the side arms 60 of the terminal head 56, as clearly shown in FIG. 4. The flange means 78 have an interference fit with the channels 76 for the last part of their travel during assembly to provide mechanical support for the subassembly 41A in service.

The details of the construction of the first resistance element 34 are shown in FIGS. 8, 9 and 10. The first resistance element 34 is illustrated as comprising first and second flat terminal conductors 84 and 86 and resistive maze means 88 extending between them. The first and second terminal conductors 84 and 86 and the resistive maze means 88 are preferably stamped, punched or otherwise formed from the electrically resistive sheet metal of which the first resistance element 34 is made. As shown, the first and second terminal conductors 84 and 86 consist of sheet metal strips or portions extending along the opposite edges of the first resistance element 34. The resistive maze means 88 comprise a considerable number of narrow resistive ribbons 90 extending transversely in the space between the first and second terminal conductors 84 and 86. A considerable number of narrow transverse slots 91 are formed between the resistive ribbons 90.

Referring to FIG. 9 the resistive maze means 88 comprise interconnecting means whereby the resistive ribbons 90 are adapted to be connected in one or more zigzag or serpentine resistive paths between the first and second terminal conductors 84 and 86. Four such paths 92, 94, 96 and 98 are shown. To form such paths, some of the left-hand ends and some of the right-hand ends of the transverse resistive ribbons 90 are connected together by short perpendicular ribbons 100, spaced away from the first and second terminal conductors 84 and 86.

The first serpentine resistive path 92 has a first end portion 92A which connects with the first terminal conductor 84 and a second end portion 92B which connects with the second terminal conductor 86, as shown in FIG. 9. Similarly, the second serpentine resistive path 94 has first and second end portions 94A and 94B which connect with the respective first and second terminal conductors 84 and 86. The third serpentine resistive path 96 has first and second end portions 96A and 96B which connect with the respective first and second terminal conductors 84 and 86. The fourth serpentine resistive path 98 has first and second end portions 98A and 98B which connect with the respective first and second terminal conductors 84 and 86. Thus, the first, second, third and fourth serpentine resistive paths 92, 94, 96 and 98 are connected in parallel between the first and second terminal conductors 84 and 86.

FIG. 8 shows the first resistance element 34 in its unfinished condition, after it has been stamped from the electrically resistive sheet metal. In this condition, the four serpentine resistive paths 92, 94, 96 and 98 are connected to the first and second flat terminal conductors 84 and 86 by a plurality of temporary severable structural webs or bridges 102. More specifically, in the construction illustrated in FIG. 8, each of the perpendicular resistive ribbons 100 is connected to either the first or the second flat terminal conductor 84 or 86 by a temporary severable structural bridge or tie bar 102 which is formed in one piece with the first and second terminal conductors 84 and 86 and with the perpendicular ribbons 100. The structural bridges 102 are simply left intact by the initial stamping of the flat resistance element 34. The retention of the structural bridges 102 during the initial stamping of the first resistance element 34 maintains the structural integrity of the resistance element 34 so that it can be handled and shipped without any difficulty.

Before the first resistance element 34 is assembled with the other components to form the finished resistor unit 30, the first resistance element 34 is subjected to a punching or other severing operation whereby all of the temporary severable structural bridges or tie bars 102 are severed or otherwise removed from the original positions between the perpendicular resistive ribbons 100 and the adjacent first and second flat terminal conductors 84 and 86. FIG. 9 illustrates the resistance element 34 with all of the temporary severable structural bridges 102 removed whereby all of the four serpentine resistive paths 92, 94, 96 and 98 are electrically normalized. However, the first resistance element 34 is somewhat lacking in structural integrity, so that it must be carefully handled when it is assembled with the other components to form the finished resistor 30.

When the first resistance element 34 is originally stamped from the resistive sheet metal, as shown in FIG. 8, the resistance unit 34 includes a plurality of severable bypass webs or bridges 104 which extend between adjacent pairs of the transverse resistive ribbons 90 whereby portions of the serpentine resistive paths 92, 94, 96 and 98 are electrically bypassed or short-circuited. In the specific construction of FIG. 8, the first resistance element 34 comprises four of the severable bypass bridges 104.

When the resistance element 34 is subjected to the punching or severing operation to remove the temporary severable structural bridges 102, as previously described, some or all of the severable bypass bridges 104 may also be removed to adjust the resistance value of the first resistance element 34. In the finished form of the resistance element 34 as shown in FIG. 9, all four of the bypass bridges 104 are still in place. Each of the bypass bridges 104 in FIG. 9 bypasses or short-circuits a portion of each of the four serpentine resistive path 92, 94, 96 and 98 and thereby reduces the electrical resistance thereof.

It will be understood that the total number and location of the severable bypass bridges 104 can be varied, and that all or any desired number of the severable bypass bridges 104 can be removed during the punching or severing operation, whereby the electrical resistance of the first resistance element 34 can be varied, as desired. The alignment tabs 48 are sheared when the bridges 102 and 104 are punched or severed.

As shown in FIGS. 8 and 9, the first and second flat terminal conductors 84 and 86 of the first resistance element 34 are formed with first and second wire-like terminal prongs 106 and 108, which are formed in one piece with the respective terminal conductors 84 and 86.

As disclosed and claimed in the copending Black and Waite Provisional Application for Patent, Ser. No. 60/046,901, filed May 9, 1997, and in the corresponding standard patent application, Ser. No. 08/947,574, filed Oct. 9, 1997, each of the prongs 106 and 108 is initially flat and in the plane of the corresponding flat terminal conductor 86 or 88. Each of the wire-like terminal prongs 106 and 108 is formed into its final shape by folding the right- and left-hand portions of the flat terminal prong 106 or 108 against the central portion thereof, without cutting the prong.

The details of the construction of the second resistance element 36 are shown in FIGS. 11, 12 and 13. The second resistance element 36 differs from the first resistance element 34 in that the second resistance element 36 is a dual resistance element which affords first and second resistance components 110 and 112. The second resistance element 36 comprises first, second and third flat terminal conductors 114, 116 and 118. The second resistance element 36 is stamped or otherwise formed in one piece from flat electrically resistive sheet material, preferably sheet metal.

A first serpentine resistive path 120 is formed between the first and second terminal conductors 114 and 116, and a second serpentine resistive path 122 is formed between the second and third terminal conductors 116 and 118. The first and second serpentine resistive paths 120 and 122 are intermingled in this case. The first serpentine resistive path 120 comprises a plurality of narrow resistive longitudinal ribbons 124 and transverse ribbons 126 which are interconnected to form the resistive path 120. Similarly, the second serpentine resistive path 122 comprises a plurality of longitudinal resistive ribbons 128 and transverse ribbons 130 which are interconnected to form the second resistive path 122. The ribbons 128 and 130 of the second serpentine resistive path 122 are wider than the ribbons 124 and 126 of the first serpentine resistive path 120, so that the second serpentine resistive path 122 can readily be distinguished from the first serpentine resistive path 120. The first and second serpentine resistive paths 120 and 122 can readily be traced in FIG. 12.

FIG. 11 shows the second resistance element 36 in its unfinished condition, after it has been stamped from the electrically resistive sheet metal. In this condition, some of the longitudinal and transverse ribbons 124, 126, 128 and 130 are connected to one another and to the terminal conductors 114, 116 and 118 by a plurality of temporary severable structural tie bars or bridges 136 which are formed in one piece with the terminal conductors and the ribbons. The structural bridges 136 are left intact by the initial stamping of the second resistance element 36 for maintaining the structural integrity of the resistance element 36 so that it can be handled and shipped without any damage or difficulty.

Before the second resistance element 36 is assembled with the other components to form the finished resistor unit 30, the second resistance element 36 is subjected to a punching or other severing operation whereby all of the temporary severable structural bridges 136 are severed or otherwise removed from the resistance element 36, as shown in FIG. 12. In this way, the serpentine resistive paths 120 and 122 are electrically normalized. However, the second resistance element 36 is somewhat lacking in structural integrity in this condition, so that the resistance element 36 must be carefully handled when it is assembled with the other components to form the finished resistor unit 30.

When the second resistance element 36 is originally stamped from the resistive sheet metal, as shown in FIG. 11, the resistance element includes at least one and preferably a plurality of severable bypass webs or bridges 138 which extend between adjacent longitudinal and transverse resistive ribbons 124, 126, 128 and 130, to bypass or short circuit portions of the serpentine resistive paths 120 and 122. Any of the bypass bridges 138 can be severed or otherwise removed by a punching or severing operation so as to increase the resistance value of the serpentine resistive paths 120 and 122, as desired. The alignment tabs 50 are sheared when the bridges 136 and 138 are punched or severed.

As shown in FIGS. 11 and 12, the first, second and third terminal conductors 114, 116 and 118 are provided with first, second and third wire-like terminal prongs 140, 142 and 144, formed in one piece with the terminal conductors 114, 116 and 118. The wire-like prongs 140, 142 and 144 may be formed in the same manner as described in connection with the wire-like prongs 106 and 108.

Figure 7:
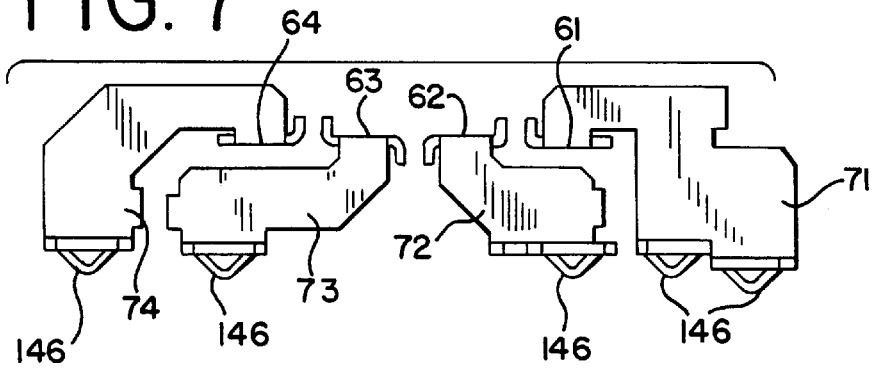
FIG. 7 is a diagrammatic rear elevational view showing the conductive metal terminals of the resistor unit, in the positions which they occupy when they are assembled with the electrically insulating component or body of the terminal head.

The wire-like prongs 108 and 144 of the resistance elements 34 and 36 are adapted to be connected to the terminal 71, while the wire-like prongs 142 and 140 are adapted to be connected to the respective terminals 73 and 74, as shown in FIG. 2. One terminal wire 145 of the thermal fuse 41 is connected to the terminal 72. To receive and anchor the wire-like prongs 108, 144, 142 and 140 and the terminal wire 145, each of the terminals 71 through 74 is formed with one or more shear formed loops 146, as shown to best advantage in FIG. 7, in which the terminals 71 through 74 are shown separately in their correct positions on the terminal head 56, but without actually showing the terminal head 56. The shear formed loops 146 are also clearly shown in FIG. 2 from which it will be observed that the loops 146 are formed in aligned pairs, except for the terminal 72 which has only one loop 146 for receiving the terminal wire 145 of the thermal fuse 41. Each of the wire-like prongs 108, 144, 142, and 140 can be inserted through the aligned loops 146 of the corresponding pair. The terminal 71 is formed with two pairs of the loops 146 for receiving two wire-like prongs 108 and 144, as shown in FIG. 2. All of the loops 146 are then strongly compressed or clenched so that the prongs 108, 144, 142 and 140 are securely and permanently clamped by the loops 146 against the corresponding terminals 71, 73 and 74. Similar shear formed loops have been disclosed and used previously for clamping the wire ends of coiled wire resistors to terminals. The strong clamping action of the compressed loops 146 insures that good electrical contact is established and maintained between the prongs 108, 144, 142 and 140 and the corresponding terminals 71, 73 and 74. The terminal wire 145 is securely attached to the terminal 72.

As previously indicated, the resistor unit 30 also comprises the thermal fuse or circuit breaker 41 which is adapted to interrupt the flow of electrical current in the resistor unit 30 when it becomes overheated to an unacceptably high temperature, due to the flow of excessive electrical current in the resistor unit 30 or abnormal lack of cooling air flow. The loss of cooling air flow is often due to a fault in the blower motor in which the rotor of the motor becomes locked. When such a fault occurs, the resistor 30 may become heated to an unacceptably high temperature, well above the normal range. The resistor current passes through the thermal fuse or circuit breaker 41, but the circuit is broken when the fuse 41 is heated externally above its rated opening temperature by the heat generated in the resistor 30.

As shown to best advantage in FIGS. 2, 4, 5 and 6, the body of the thermal fuse 41 is resiliently held against a seat or clip 150 formed on the front edge of the midplate 40, so that heat is conductively transferred between the midplate 40 and the fuse 41. The heat generated by the resistance elements 34 and 36 is conductively transferred to the midplate 40 through the thin inner electrical insulators 38B.

As shown in FIGS. 2 and 5, the thermal fuse 41 is made with first and second terminal leads or wires 145 and 154. The first terminal wire 145 extends forwardly and is connected to the terminal 72, which has a shear formed loop 146 thereon, through which the lead 145 is inserted. The loop 146 is then forcibly compressed or clenched, whereby the wire 145 is securely and permanently clamped to the terminal 72.

The second terminal lead or wire 154 extends laterally from the thermal fuse 41 and is inserted through a pair of the shear formed loops 146 which are formed on a tab or flange 156 bent from the midplate 40, substantially perpendicular thereto, which acts as an electrically conductive tie bar or terminal. The terminal lead 154 is slipped through the loops 146 which are then forcibly compressed or clenched, so as to clamp the lead or wire 154 securely against the tab 156.

The midplate 40 has a second tab or portion 158 on which two of the loops 146 are formed, for receiving the rearwardly projecting wire-like prong 106 on the first resistance element 34. The loops 146 are forcibly compressed or clenched so that the prong 106 is securely clamped to the tab 158. The midplate 40 serves as a tie bar or terminal between the end lead 154 of the thermal fuse 41 and the rearwardly projecting prong 106 on the resistance element 34. Thus, the thermal fuse 41 initially establishes an electrically conductive path between the wire-like prong 106 and the terminal 72.

The heat normally generated in the resistor 30 is conducted to the thermal fuse 41, so that the temperature of the thermal fuse 41 is raised to approximately the same temperature that is produced in the midplate 40 of the resistor 30. However, the thermal fuse 41 is selected to withstand the highest temperature that is normally produced in the midplate 40. If the temperature of the resistor 30 is raised to an abnormally high value, due to a fault in the blower motor, such as a locked rotor, the thermal fuse 41 is heated to a temperature which substantially exceeds its rated value, with the result that the fusible component in the fuse 41 is melted, so that the resistor circuit is broken. The thermal fuse 41 prevents the development of a dangerously high temperature in and around the resistor 30, so that the hazard of a fire or other mishap is obviated.

Figure 19:
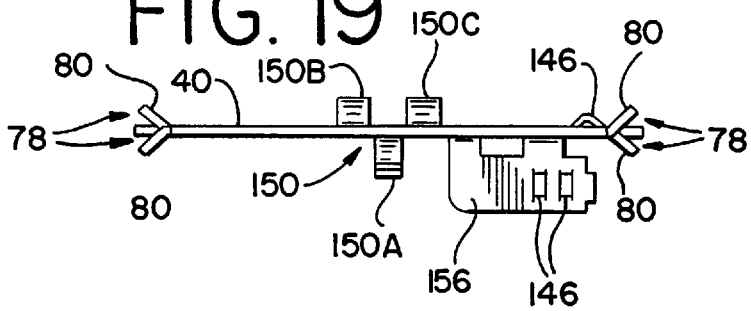
FIG. 19 is a rear elevational view of the midplate.

The seat or clip 150 may assume various forms but is shown as comprising a central tab or lug 150A (FIGS. 18 and 19) bent from the midplate 40 at a slanting angle in one direction, and second and third tabs or lugs 150B and 150C which are bent from the midplate 40 at a slanting angle in the opposite direction. The second and third lugs 150B and 150C are on opposite sides of the lug 150A, as shown in FIGS. 18 and 19. The lugs 150A, 150B and 150C constitute the seat 150 which is generally V-shaped and is adapted to receive the cylindrical body of the thermal fuse 41 with the body in engagement with all three lugs 150A, 150B and 150C, as shown to best advantage in FIGS. 1, 5 and 6.

The thermal fuse is resiliently pressed or clamped against the seat 150 by resilient spring means in the form of a generally U-shaped wire spring 155 shown to best advantage in FIGS. 5 and 6. The wire spring 155 has a central U-shaped portion 155A and first and second arms 155B and 155C extending from opposite sides of the curved U-shaped portion 155A. The arms 155B and 155C have end prongs 155D and 155E which are bent laterally in opposite directions, as shown in FIG. 6.

The U-shaped wire spring 155 is installed by hooking the U-shaped central portion 155A behind the central lug 150A and pushing the arms 155B and 155C against the thermal fuse 41. The arms 155B and 155C are then compressed and pushed against and along first and second ramp-like slanting end portions 150D and 150E on the second and third side lugs 150B and 150C. The slanting portions 150D and 150E compress the side arms 155B and 155C until they enter or engage and interlock with first and second locking notches or catches 150F and 150G formed in the second and third slanting portions 150D and 150E. The person installing the wire spring 155 must exert sufficient force on the spring 155 to flex the arms 155B and 155C against and part way around the body of the thermal fuse 41, so that it is firmly clamped against the seat 150 by the spring 155. Other spring means could be provided for resiliently clamping the fuse 41 against the seat 150 on the midplate 40.

The thermal fuse 41, the seat or clip 150 and the spring 155 are protected and shielded by a guard, flange or tab 157 formed in one piece with the terminal head 56 and projecting rearwardly from the front plate portion 58 thereof, as shown to best advantage in FIGS. 1 and 2. The guard 157 tends to prevent accidental damage to the thermal fuse 41, while also tending to prevent accidental disconnection of the U-shaped wire spring 155.

Figure 20:
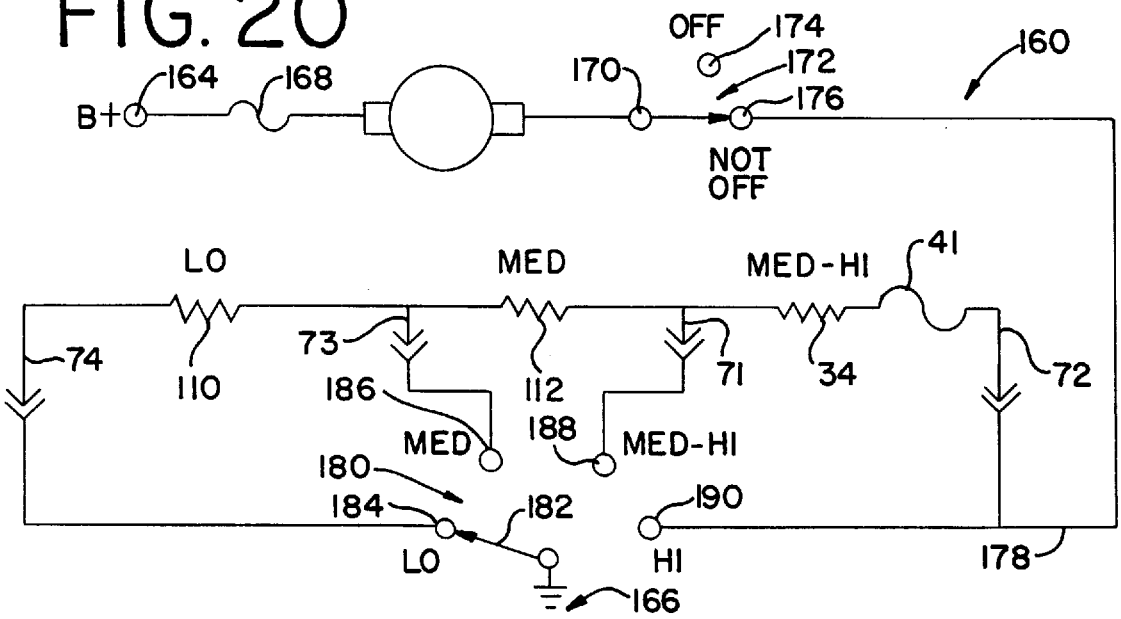
FIG. 20 is a schematic electrical circuit diagram illustrating a typical use of the resistor unit for controlling the speed of a blower motor in an automotive air control system.

FIG. 20 is a schematic circuit diagram of an illustrative electrical circuit 160 whereby the resistor 30 is utilized to control the speed of a blower motor 162 for an automotive air control system, which may be employed for heating, ventilating and air conditioning an automotive vehicle. The control circuit 160 is adapted to be connected between the positive and negative terminals of the automotive battery, not shown. The circuit 160 comprises a B+ terminal 164 which is adapted to be connected to the positive terminal of the battery. The negative terminal of the battery is connected to the conductive frame of the vehicle. The control circuit 160 has a negative or ground terminal 166, shown in FIG. 20 as a ground symbol, representing a connection to the frame of the vehicle.

In the circuit 160, an ordinary fuse or circuit breaker 168 is connected in series with the blower motor 162 between the B+ terminal 164 and the movable contact 170 of a shutoff switch 172. The movable contact 170 is movable between a first fixed contact 174, labeled OFF and a second fixed contact 176 labeled NOT OFF, which could be designated the ON contact.

The circuit 160 comprises means including a conductor 178 connected between the second fixed contact 176 and the terminal 72 of the resistor 30 in which the components are connected in a series circuit between terminals 72 and 74. The series circuit comprises the thermal fuse 41, the midplate 40, the first resistance element 34, the terminal 71, the resistance component 112, the terminal 73, and the resistance component 110 which is connected to the terminal 74. When all three of the resistance elements, 34, 112 and 110 are connected in series with the blower motor 162, it is operated at its slowest speed.

A four-position speed control switch 180 is provided for progressively switching the resistance elements 110, 112 and 34 into and out of the circuit 160 to decrease and increase the speed of the motor 162. The illustrated switch 180 comprises a movable contact 182 which is connected to the negative terminal or ground 166 whereby the movable contact 182 is connected to the negative terminal of the automotive battery. The movable contact 182 is movable successively into engagement with a first fixed contact 184, labeled LO, a second fixed contact 186, labeled MED, a third fixed contact 188, labeled MED-HI and a fourth fixed contact 190, labeled HI.

The first fixed contact 184 is connected to the terminal 74 of the resistor 30. The second, third and fourth fixed contacts 186, 188 and 190 are connected to the resistor terminals 73, 71 and 72, respectively.

When the movable contact 182 engages the first fixed contact 184, all three of the resistance elements 110, 112 and 34 are connected in series with the blower motor 162, so that it operates at low speed. When the movable contact 182 engages the second fixed contact 186, the resistance elements 112 and 34 are connected in series with the motor 162, so that it operates at a medium speed. When the movable contact 182 is engaged with the third fixed contact 188, only the resistance element 34 is connected in series with the motor 162, so that it operates at a medium-high speed. When the movable contact 182 engages the fourth fixed contact 190, none of the resistance elements 110, 112 and 34 is connected in series with the motor 162, so that it operates at its high or maximum speed.

We claim:

1. A flat resistor, comprising the following separate generally flat components assembled into a stack in the following order:

a first flat metal outer plate having a plurality of assembly tabs bent transversely therefrom, a first thin flat outer electrical insulator having alignment slots therein for receiving said tabs with an alignment fit, a first thin flat sheet metal electrical resistance element separate from said first insulator and having oversized slots therein for receiving said tabs with a clearance fit for obviating any engagement between said tabs and said first resistance element, a first thin flat inner electrical insulator separate from said first electrical resistance element and having alignment slots therein for receiving said tabs with an alignment fit, a metal midplate having oversize slots therein for receiving said tabs with a clearance fit, a second thin flat inner insulator having alignment slots therein for receiving said tabs with an alignment fit, a second thin flat sheet metal resistance element separate from said second inner insulator and having oversize slots therein for receiving said tabs with a clearance fit for obviating any engagement between said tabs and said second resistance element, a second thin flat outer insulator separate from said second electrical resistance element and having alignment slots therein for receiving said tabs with an alignment fit, and a second metal outer plate having alignment slots therein for receiving said tabs with an alignment fit, said tabs on said first outer plate being bent into secure engagement with said second outer plate for compressing and retaining the stack of said components.

2. A flat resistor according to claim 1, in which each of said resistance elements is in the form of a resistive sheet metal stamping having portions comprising first and second end terminals, and a plurality of resistive ribbons interconnected between said terminals and formed in one piece therewith.

3. A flat resistor according to claim 2, in which at least one of said resistance elements comprises an intermediate terminal, said ribbons being interconnected between said first terminal and said intermediate terminal and also between said intermediate terminal and said second terminal.

4. A flat resistor according to claim 1, in which each of said resistance elements comprises a pair of alignment tabs sheared therefrom and bent outwardly toward the adjacent outer insulator, said outer insulators having additional alignment slots therein for closely receiving said alignment tabs on the adjacent resistance elements to prevent any engagement between said resistance elements and said alignment tabs on said first outer plate.

5. A flat resistor according to claim 4, in which each of said outer plates comprises portions for forming recesses in said outer plates opposite said outer plates opposite said alignment tabs on said resistance elements for obviating any contact between said resistance elements and the corresponding outer plates.

6. A flat resistor, comprising the following separate generally flat components assembled into a stack in the following order:

a first flat sheet metal supporting plate, a first thin flat electrical insulator, a flat sheet metal electrical resistance element separate from said first insulator, a second thin flat electrical insulator separate from said electrical resistance element, and a second sheet metal supporting plate, said resistor also comprising a plurality of assembly members extending between said first and second supporting plates for securing said plates together and for clamping said insulators and said resistance element therebetween, said insulators having alignment openings therein for receiving said members with an alignment fit, said resistance element having oversize openings therein for receiving said members with a clearance fit for obviating any contact between said resistance element and said members, said resistance element comprising a plurality of alignment tabs formed in one piece with said resistance element and extending transversely toward said first insulator, said first insulator having alignment slots therein for receiving said alignment tabs on said resistance element with an alignment fit to maintain alignment between said resistance element and said first insulator.

7. A flat resistor according to claim 6, in which said first supporting plate comprises portions for forming voids therein opposite said alignment tabs for obviating any contact between said alignment tabs and said first supporting plate.

8. A flat resistor according to claim 7, in which said voids take the form of recesses in said first supporting plate formed opposite said alignment tabs on said resistance element.

9. A flat resistor according to claim 8, in which said recesses are provided by embossments formed in said first supporting plate whereby the recesses are formed on one side of said first supporting plate and protrusions are formed on the opposite side thereof.

10. A flat resistor, comprising the following separate generally flat components assembled in a stack in the following order:

a flat metal outer plate having a plurality of assembly members extending transversely therefrom, a first thin flat outer electrical insulator having alignment openings therein for receiving said assembly members with an alignment fit, a first thin flat sheet metal electrical resistance element separate from said first outer insulator and having oversize openings therein for receiving said assembly members with a clearance fit for obviating any engagement between said assembly members and said first resistance element, a first thin flat inner electrical insulator separate from said first electrical resistance element and having alignment openings therein for receiving said assembly members with an alignment fit, a metal midplate having oversize openings therein for receiving said assembly members with a clearance fit, a second thin flat inner insulator having alignment openings therein for receiving said alignment members with an alignment fit, a second thin flat sheet metal electrical resistance element separate from said second inner insulator and having oversize openings therein for receiving said assembly members with a clearance fit for obviating any engagement between said assembly members and said second resistance element, a second thin flat outer insulator separate from said second electrical resistance element and having alignment openings therein for receiving said alignment members with an alignment fit, and a second metal outer plate having alignment openings therein for receiving said assembly members with an alignment fit, said assembly members including means for compressing and retaining the stack of said components together, each of said resistance elements comprising a plurality of alignment tabs formed thereon and bent outwardly toward the adjacent outer insulator, said outer insulators having alignment slots therein for closely receiving said alignment tabs on the adjacent resistance elements to prevent any engagement between said resistance elements and said assembly members.

11. A flat resistor according to claim 10, in which each of said outer plates comprises portions forming voids therein opposite said alignment tabs for obviating any contact between said resistance elements and the corresponding outer plates.

12. A flat resistor, comprising the following separate generally flat components assembled into a stack in the following general order:

a first flat electrically conductive supporting plate, a first flat electrical insulator, a thin flat electrical resistance element separate from said first insulator, a second thin flat electrical insulator separate from said electrical resistance element, and a second electrically conductive supporting plate, said resistor also comprising a plurality of assembly members extending between said first and second supporting plates for securing said plates together and for clamping said insulators and said resistance element therebetween, said insulators having alignment openings therein for receiving said members with an alignment fit, said resistance element having oversize openings therein for receiving said members with a clearance fit for obviating any electrical contact between said resistance element and said members, said resistance element comprising a plurality of alignment elements formed in one piece with said resistance element and extending transversely toward said first insulator, said first insulator having alignment openings therein for receiving said alignment elements on said resistance element with an alignment fit to maintain alignment between said resistance element and said first insulator.

13. A flat resistor according to claim 12, in which said first supporting plate comprises portions for forming voids therein opposite said alignment elements for obviating any contact between said alignment elements and said first supporting plate.

14. A flat resistor according to claim 13, in which said voids take the form of recesses in said first supporting plate formed opposite said alignment elements on said resistance element.

15. A flat resistor according to claim 14, in which said recesses are provided by embossments formed in said first supporting plate such that the recesses are formed on one side of said first supporting plate and protrusions are formed on the opposite side thereof.

16. A thermally fused flat resistor, comprising the combination of the following separate generally flat components assembled into a stack in the following general order:

a first flat electrically conductive supporting plate, a first thin flat electrical insulator, a thin flat electrical resistance element separate from said first insulator, a second thin flat electrical insulator separate from said electrical resistance element, and a second electrically conductive supporting plate, said resistor also comprising means extending between said first and second supporting plates for securing said plates together and for clamping said insulators and said resistance element therebetween, one of said plates having projecting means thereon forming a seat, a thermal fuse engaging said seat, and spring means mounted on said second plate for resiliently pressing said fuse against said seat.

17. A resistor according to claim 16, in which said spring means comprise a wire spring mounted on said second plate and resiliently pressing said fuse against said seat on said second plate.

18. A flat resistor, comprising the following separate generally flat components assembled into a stack in the following general order:

a first flat metal cover plate, a first thin flat outer electrical insulator, a first thin flat electrical resistance element separate from said first outer insulator, a first thin flat inner electrical insulator separate from said first electrical resistance element, a metal midplate, a second thin flat inner electrical insulator, a second thin flat resistance element separate from said second inner insulator, a second thin flat outer insulator separate from said second resistance element, and a second metal outer plate, said midplate having projecting structure thereon forming a seat, a thermal fuse engaging said seat, and spring means mounted on said midplate for resiliently pressing said fuse against said seat.

19. A flat resistor, comprising the following generally flat components assembled into a stack in the following order:

a first flat metal outer plate having a plurality of assembly tabs bent transversely therefrom, a first thin flat outer electrical insulator having alignment slots therein for receiving said tabs with an alignment fit, a first thin flat sheet metal electrical resistance element having oversize slots therein for receiving said tabs with a clearance fit for obviating any engagement between said tabs and said first resistance element, a first thin flat inner electrical insulator having alignment slots therein for receiving said tabs with an alignment fit, a metal midplate having oversize slots therein for receiving said tabs with a clearance fit, a second thin flat inner insulator having alignment slots therein for receiving said tabs with an alignment fit, a second thin flat sheet metal resistance element having oversize slots therein for receiving said tabs with a clearance fit for obviating any engagement between said tabs and said second resistance element, a second thin flat outer insulator having alignment slots therein for receiving said tabs with an alignment fit, and a second metal outer plate having alignment slots therein for receiving said tabs with an alignment fit, said tabs on said first outer plate being bent into secure engagement with said second outer plate for compressing and retaining the stack of said components, in which each of said resistance elements comprising a pair of alignment tabs sheared therefrom and bent outwardly toward the adjacent outer insulator, said outer insulators having additional alignment slots therein for closely receiving said alignment tabs on the adjacent resistance elements to prevent any engagement between said resistance elements and said alignment tabs on said first outer plate, each of said outer plates comprising portions for forming recesses in said outer plates opposite said alignment tabs on said resistance elements for obviating any contact between said resistance elements and the corresponding outer plates, each of said alignment tabs on said resistance elements including an end portion bent transversely relative thereto against the corresponding outer insulator and forming a flange for securing each resistance element and the corresponding outer insulator together to facilitate assembly of the components, each flange being opposite the corresponding recess in the corresponding outer plate, each recess affording clearance between the corresponding flange and the corresponding outer plate.

20. A flat resistor, comprising the following generally flat components assembled into a stack in the following order:

a first flat sheet metal supporting plate, a thin flat electrical insulator, a flat sheet metal electrical resistance element, a second thin flat electrical insulator, and a second sheet metal supporting plate, said resistor also comprising a plurality of assembly members extending between said first and second supporting plates for securing said plates together and for clamping said insulators and said resistance element therebetween, said insulators having alignment openings therein for receiving said members with an alignment fit, said resistance element having oversize openings therein for receiving said members with a clearance fit for obviating any contact between said resistance element and said members, said resistance element comprising a plurality of alignment tabs formed in one piece with said resistance element and extending transversely toward said first insulator, said first insulator having alignment slots therein for receiving said alignment tabs on said resistance element with an alignment fit to maintain alignment between said resistance element and said first insulator, said first supporting plate comprising a portion thereof for forming voids therein opposite said alignment tabs for obviating any contact between said alignment tabs and said first supporting plate, said voids taking the form of recesses in said first supporting plate formed opposite said alignment tabs on said resistance element, said recesses being provided by embossments formed in said first supporting plate whereby the recesses are formed on one side of said first supporting plate and protrusions are formed on the opposite side thereof, each of said alignment tabs on said resistance element including an end portion bent transversely relative thereto against the corresponding insulator and forming a flange for securing said resistance element and the corresponding insulator together to facilitate assembly of the components, each flange being opposite the corresponding recess in the corresponding supporting plate, each recess affording clearance between each flange and the corresponding supporting plate.

21. A flat resistor, compromising the following generally flat components assembled in a stack in the following order:

a flat metal outer plate having a plurality of assembly members extending transversely therefrom, a first thin flat outer electrical insulator having alignment openings therein for receiving said assembly members with an alignment fit, a first thin flat sheet metal electrical resistance element having oversize openings therein for receiving said assembly members with a clearance fit for obviating any engagement between said assembly members and said first resistance element, a first thin flat inner electrical insulator having alignment openings therein for receiving said assembly members with an alignment fit, a metal midplate having oversize openings therein for receiving said assembly members with a clearance fit, a second thin flat inner insulator having alignment openings therein for receiving said alignment members with an alignment fit, a second thin flat sheet metal resistance element having oversize openings therein for receiving said assembly members with a clearance fit for obviating any engagement between said assembly members and said second resistance element, a second thin flat outer insulation having alignment openings therein for receiving said alignment members with an alignment fit, and a second metal outer plate having alignment openings therein for receiving said assembly members with an alignment fit, said assembly members including means for compressing and retaining the stack of said components together, each of said resistance elements comprising a plurality of alignment tabs formed thereon and bent outwardly toward the adjacent outer insulator, said outer insulators having alignment slots therein for closely receiving said alignment tabs on the adjacent resistance elements to prevent any engagement between said resistance elements and said assembly members, each of said outer plates comprising a portion thereof forming voids therein opposite said alignment tabs for obviating any contact between said resistance elements and the corresponding outer plates, each of said alignment tabs on said resistance elements including and end portion bent transversely relative thereto against the corresponding outer insulator and forming a flange for securing each resistance element and the corresponding outer insulator together to facilitate the assembly of the components, each flange being opposite the corresponding void in the corresponding outer plate, each void affording clearance between the corresponding flange and the corresponding outer plate.

22. A flat resistor according to claim 21, in which said voids take the form of recesses formed in said outer plates opposite said alignment tabs on said resistance elements.

23. A flat resistor according to claim 22, in which said recesses in said outer plates are provided by embossments formed in said outer plates and having said recesses opposite said alignment tabs and protuberances projection outwardly for said outer plates, said recesses being effective to obviate any contact between said alignment tabs and said outer plates.

24. A thermally fused flat resistor, comprising the combination of the following generally flat components assembled into a stack in the following general order:

a first flat electrically conductive supporting plate, a first thin flat electrical insulator, a thin flat electrical resistance element, a second thin flat electrical insulator, and a second electrically conductive supporting plate, said resistor also comprising means extending between said first and second supporting plates for securing said plates together and for clamping said insulators and said resistance element therebetween, one of said plates having projecting structure thereon forming a seat, a thermal fuse engaging said seat, and spring means mounted on said last mentioned plate for resiliently pressing said fuse against said seat, said seat comprising a first lug bent from said one of said plates at a slanting angle in one direction, and second and third lugs bent from said one of said plates at a slanting angle in the opposite direction and disposed on opposite sides of said first lug whereby said seat is generally V-shaped, said spring means being connected between said first lug and said second and third lugs and being flexed against said fuse for pressing said fuse against said seat.

25. A resistor according to claim 24, in which said spring means comprise a wire spring having a U-shaped portion hooked around said first lug and first and second arm portions extending from opposite ends of said U-shaped portion and resiliently flexed part way around said fuse for pressing said fuse against said seat, said second and third lugs having releasible locking means for releasibly retaining said arms.

26. A resistor according to claim 25, in which said first and second lugs comprise first and second oppositely slanting ramp-like end portions for slidable engagement by said first and second arms of said wire spring, said locking means comprising first and second catches on said oppositely slanting ramp-like end portions for receiving and releasibly locking said arms against said respective second and third lugs.

27. A resistor according to claim 26, in which said catches comprise locking notches formed in said second and third ramp-like slanting portions for receiving and retaining said arms of said spring in their resiliently flexed positions for pressing said fuse against said seat.

28. A flat resistor, comprising the following generally flat components assembled into a stack in the following general order:

a first flat metal cover plate, a first thin flat outer electrical insulator, a first thin flat electrical resistance element, a first thin flat inner electrical insulator, a metal midplate, a second thin flat inner electrical insulator, a second thin flat resistance element, a second thin flat outer insulator, and a second metal outer plate, said midplate having projecting structure thereon forming a seat, a thermal fuse engaging said seat, and spring means mounted on said midplate for resiliently pressing said fuse against said seat, said spring means comprising a wire spring mounted on said midplate and resiliently pressing said fuse against said seat on said midplate.

29. A flat resistor, comprising the following generally flat components assembled into a stack in the following general order:

a first flat metal cover plate, a first thin flat outer electrical insulator, a first thin flat electrical resistance element, a first thin flat inner electrical insulator, a metal midplate, a second thin flat inner electrical insulator, a second thin flat resistance element, a second thin flat outer insulator, and a second metal outer plate, said midplate having projecting structure thereon forming a seat, a thermal fuse engaging said seat, and spring means mounted on said midplate for resiliently pressing said fuse against said seat, said seat comprising a first lug bent from said midplate at a slanting angle in one direction, and second and third lugs bent from said midplate at a slanting angle in the opposite direction and disposed on opposite sides of said first lug whereby said seat is generally V-shaped, said spring means being connected between said first lug and said second and third lugs and being flexed against said fuse for pressing said fuse against said seat, said seat comprising a first lug bent from said midplate at a slanting angle in one direction, and second and third lugs bent from said midplate at a slanting angle in the opposite direction and disposed on opposite sides of said first lug whereby said seat is generally V-shaped, said spring means being connected between said first lug and said second and third lugs and being flexed against said fuse for pressing said fuse against said seat.

30. A resistor according to claim 29, said spring means comprising a wire spring having a U-shaped portion hooked around said first lug, said spring also comprising first and second arms extending from opposite ends of said U-shaped portion and resiliently flexed part way around said fuse for pressing said fuse against said seat, said second and third lugs having releasible locking means for releasibly retaining said arms.

31. A resistor according to claim 30, in which said first and second lugs comprise first and second oppositely slanting ramp-like end portions for slidable engagement by said first and second arms of said wire spring, said locking means comprising first and second catches on said oppositely slanting ramp-like end portions for receiving and releasibly locking said arms against said respective second and third lugs.

32. A resistor according to claim 31, in which said catches comprise locking notches formed in said second and third ramp-like slanting portions for receiving and retaining said arms of said spring in their resiliently flexed positions for pressing said fuse against said seat.

* * * * *